United States Patent [19]

Hall

[11] 4,076,239

[45] Feb. 28, 1978

[54] TENNIS TEACHING AID

[75] Inventor: Charles O. Hall, San Bernardino, Calif.

[73] Assignees: Sherman R. Plummer, Burbank; Randall Porter, Homewood, both of Calif. ; part interest to each

[21] Appl. No.: 709,798

[22] Filed: Jul. 29, 1976

[51] Int. Cl.[2] ..... A63B 69/38

[52] U.S. Cl. ..... 273/29 A; 273/73 R

[58] Field of Search ..... 273/29 R, 29 A, 73 R, 273/73 D, 67 R, 97 R, 98, 58 C, 95 A

[56] References Cited

U.S. PATENT DOCUMENTS

| | | | |
|---|---|---|---|
| 3,820,785 | 6/1974 | Occhipinti | 273/73 R X |
| 3,874,666 | 4/1975 | Ross | 273/73 R |

*Primary Examiner*—Richard C. Pinkham
*Assistant Examiner*—T. Brown
*Attorney, Agent, or Firm*—Fulwider, Patton, Rieber, Lee & Utecht

[57] ABSTRACT

A tennis teaching aid for use in instructing tennis players how to strike a tennis ball more consistently with a particular area of the tennis racket known as the "sweet spot," so that the ball is moved with a greater velocity and the player is afforded better control over each shot. The device includes two flat plates of relatively stiff but resilient material, disposed one on each side of the strings of the racket and clamped together about the strings by four threaded nuts and bolts engaging aligned holes in the plates. The device is provided with at least one area of padding material placed near the edge of each plate and between each plate and the strings of the tennis racquet to emit a distinctive sound when struck at its center by a tennis ball, and gives out another distinctive but different sound when struck at an off-center location.

7 Claims, 6 Drawing Figures

Fig. 1
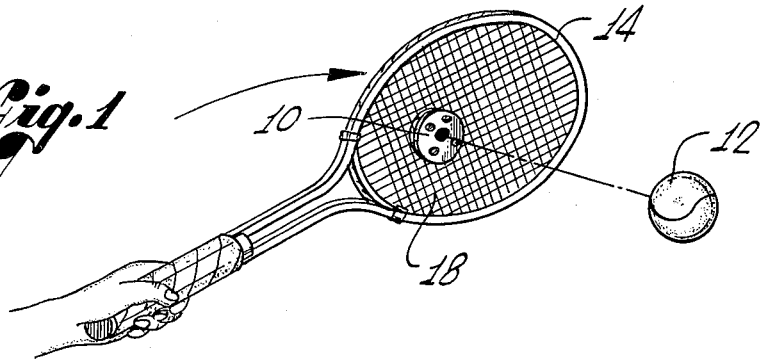
Fig. 2
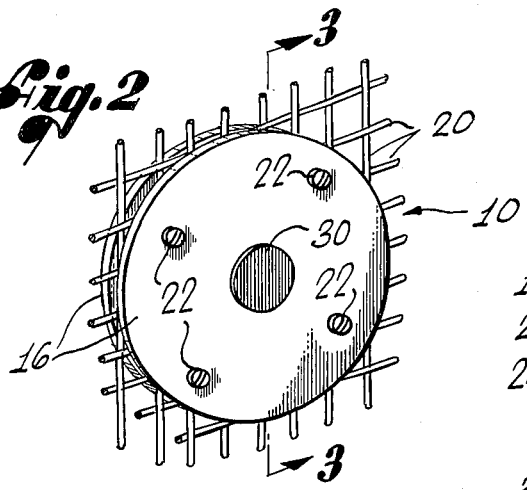
Fig. 3
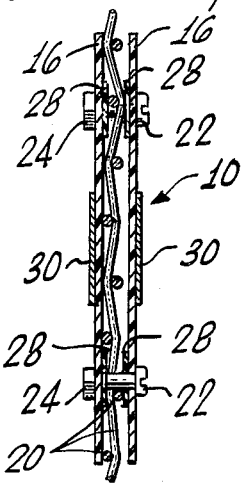
Fig. 4
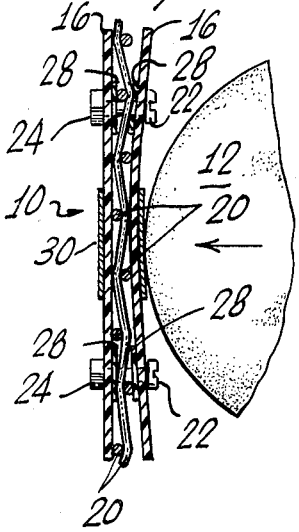
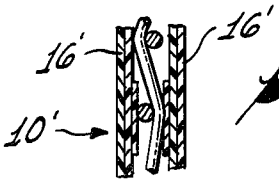
Fig. 6
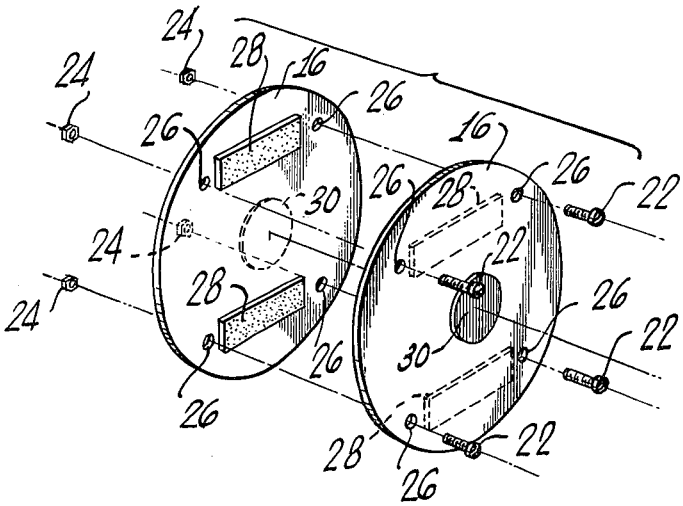
Fig. 5

TENNIS TEACHING AID

BACKGROUND OF THE INVENTION

The present invention relates generally to teaching aids for the game of tennis, and, more particularly, to teaching aids for developing player skill in striking a tennis ball with a tennis racket in such a manner that the ball is contacted by a desired particular portion of the stringed area of the racket.

As is well known to players and teachers of the game of tennis, a tennis racket has a particular, relatively small portion of its stringed area which provides a maximum response when the tennis ball is struck by this portion. This high-response area of the strings is widely known as the "sweet spot" of the racket, and consistently striking the ball with this area gives the player better control of the ball, and allows the ball to be driven from the racket with a significantly higher velocity than would otherwise be obtainable. The sweet spot of the racket is not in exactly the geometric center of the stringed area of the racket, but is located slightly off-center, closer to the handle of the racket.

As is also well known to players and teachers of tennis, contacting the ball with any portion of the racket other than the sweet spot can produce severe twisting and other stresses on the racket, and these are transmitted to the arm of the player. Hitting the ball consistently with the sweet area reduces these stresses, and thereby reduces any likelihood of "tennis elbow" and other common complaints of amateur tennis players.

Various techniques have been tried over the years to provide players with a simple and convenient indication as to whether they were contacting the sweet spot of the racket. One technique for indicating that the sweet spot has been contacted involves the use of sensors of various kinds attached to the racket strings and wired to a sound-producing device to provide an audible indication when the ball strikes the sweet spot.

Another device utilizes a small square or rectangular sheet of material secured to the stringed area by bolts and washers, and spaced above the strings by spacers. The sheet of material is intended to give out a distinctive sound when struck by a tennis ball in its center. However, it can work only for one side of the tennis racket, therefore precluding its use for backhand shots. Moreover, since the sheet is raised a substantial distance above the strings of the racket, the ball will be significantly deflected from its intended path if the edge of the device is struck.

It will be appreciated from the foregoing that there is still a definite need for a simple and inexpensive teaching aid which will provide a positive indication to the player whenever the sweet spot of the racket contacts the tennis ball. The present invention fulfills this need.

SUMMARY OF THE INVENTION

The present invention resides in a device for providing an audible indication when a tennis ball is struck with the sweet spot of a tennis racket. Briefly, and in generally terms, the device includes two relatively small flat plates of stiff but resilient material, disposable one on each side of the tennis racket at the desired sweet spot area, at least one area of padding material affixed to the side of each of the plates adjacent the racket strings, and a plurality of compressing fasteners disposed through gaps between the strings, for tightening the plates together onto the strings. When this device is struck at its geometric center, it gives out a distinctive sound, and when it is struck at an off-center location it gives out a second and different distinctive sound. When the device is attached to a tennis racket during practice, the player will quickly learn to associate the feeling of striking the ball exactly on the sweet spot of the racket, with the distinctive sound emitted by the device when it is struck at its center. It is estimated that an hour of practice using the device is equivalent to many hours of practice without it, i.e., relying only upon a coach to indicate whether or not the player is striking the ball in the correct area of the racket.

In the presently preferred embodiment of the invention, the flat plates are circular, and the compressing fasteners are threaded nuts and bolts disposed through corresponding holes near the periphery of each of the plates. The nuts and the bolt heads are relatively small and have only an insignificant effect on the path of the tennis ball, if it should strike a bolt or nut directly.

The flat plates may be of any material having mechanical properties which produce the desired result. In the presently preferred form of the invention, the plate material is a high-pressure laminated plastic material of the type used for decorative and protective purposes on table tops and the like. Best results have been obtained using a double thickness of such a laminated material, the two thicknesses being bonded together with an epoxy adhesive. However, other plastic laminates of suitable single thickness could be employed to obtain similar results.

In the preferred embodiment, the side of each plate adjacent the strings has affixed to it a pair of diametrically opposite felt pads, which function to cushion the plate in its contact with the springs, and thereby avoid a "tinny" sound which might result if the plates were allowed to come into complete contact with the strings.

It will be appreciated from the foregoing that the present invention represents a significant advance in the field of tennis teaching aids for the general purpose described. In particular, the invention provides a convenient and relatively inexpensive device for teachings tennis players to strike the ball with the sweet spot of the tennis racket. Other aspects and advantages of the invention will become apparent from the following more detailed description taken in conjunction with the accompanying drawings.

BRIEF DESCRIPTION OF THE DRAWINGS

FIG. 1 is a perspective view of the device of the invention attached to a tennis racket;

FIG. 2 is an enlarged perspective view of the device, similar to FIG. 1;

FIG. 3 is a further enlarged sectional view of the device taken substantially along the line 3—3 of FIG. 2;

FIG. 4 is a sectional view similar to FIG. 3, and showing a tennis ball stricking the device;

FIG. 5 is an exploded perspective view of the device; and

FIG. 6 is a fragmentary sectional view of an alternate form of the device.

DETAILED DESCRIPTION

As shown in the drawings for purposes of illustration, the present invention is embodied in a device, indicated by reference numeral 10, for use as a tennis teaching aid in instructing tennis players to hit a tennis ball 12 with that part of a tennis racket 14 known as the "sweet spot." More consistent use of the sweet spot area of the racket imparts a greater velocity to the ball and gives the player better control over each shot, as well as reducing excessive strain on the player's elbow and other parts of the body. Learning to hit the ball with the sweet spot of the racket can take many hours of instruction unless the player is provided with some form of continual indication as to whether the sweet spot has been contacted.

In accordance with the present invention, the device 10 is attached to the racket 14 at the location of the sweet spot, and is utilized to produce a distinctive sound when struck at its center by the tennis ball 12, and to produce a different distinctive sound when struck at an off-center location. When the sweet spot is struck precisely by the ball 12, the device 10 emits a sharp, abrupt clicking sound. If the device 10 is struck off-center, however, the sound emitted is muffled and unclear. The player quickly learns to associate these distinctive sounds with the physical sensations felt at the moment of impact between the racket 14, and the ball 12. Basically, then, the invention utilizes what have become known as bio-feedback principles, to give the player a positive audible indication of one kind whenever the ball 12 is struck in the correct area of the racket 14, and to give an audible indication of a different kind when the ball is struck slightly away from the desired sweet spot area. The player has only to concentrate on producing a particular sound, and the desired skill will become automatic after a time. There is, of course, an audible indication of a third kind when the ball 12 strikes the racket 14 well away from the sweet spot area, i.e., not impinging on the device 10 at all.

As will be apparent from the drawings, the device 10 comprises two circular flat plates 16 disposed one on each face of the stringed area 18 of the tennis racket. The stringed area 18, of course, comprises a plurality of strings 20 stretched across the racket frame in two directions substantially perpendicular to each other, the strings in one direction being interwoven with those in the other direction. The plates 16 are centered over the sweet spot of the tennis racket 14, and are clamped together by four threaded bolts 22 and threaded nuts 24, the bolts being inserted through aligned holes 26 near the periphery of each of the plates. To avoid the possibility of damage to the strings 20 of the racket 14, the bolts 22 should be threaded only at their ends on which the nuts 24 are engaged.

On the inner face of each of the plates 16, are affixed two pads 28 of felt or similar material, to contact the strings 20 and prevent an otherwise "tinny" sound that would result from the plates being clamped down on the strings alone. On the outer faces of the plates 16 a small target area 30 may be drawn or affixed. Use of the target area 30 appears to accelerate the teaching process even further. Although the player should be watching the ball 12 as he makes each stroke, the presence of the target area 30 still seems to play an important part in re-enforcing the instruction to strike the ball with the desired area of the racket 14.

In the illustrated embodiment, the flat plates 16 are of approximately 3 inches diameter and the bolt holes 26 are located at the corners of a square of approximately 1 ⅝ inches length on each side. This arrangement allows the bolts 22 to be located in gaps between the strings 20 of most rackets.

The material selected for the plates 16 has to have mechanical characteristics which produce the desired result, i.e., giving an audible sound of one distinctive kind when struck at its center by the tennis ball 12, and giving an audible sound of the different distinctive kind when struck at an off-center location. No experiments have yet been conducted to determine the specific mechanical characteristics required, for the plate material, such as stiffness, modulus of elasticity, and so on. However, various materials have been field-tested while installed on tennis rackets, and it has been found that high-pressure laminated plastics, of the kind used as decorative or protective finishes on table tops and the like, have mechanical characteristics closest to those desired. Presently preferred is a double thickness of a plastic laminate known as "Conoflex," manufactured by Woodall Industries, Inc., of Carpenter, Ill., the two thicknesses being bonded together with an epoxy adhesive. However, other plastic laminates or other similar materials might be used in single-thickness form, if the desired mechanical properties were obtained.

FIG. 6 illustrates the presently preferred, double-thickness plate, indicated by reference numeral 16'. In this embodiment, the double-thickness plates 16' are approximately one-eighth of an inch in thickness.

The location of the sweet spot on a tennis racket is not, of course, part of the invention. Most tennis rackets have 18, 19, or 20 horizontal strings, i.e., strings at right angles to the racket handle. For an 18-string racket, the device 10 should be positioned between the 11th and 12th strings, counting down from the top or remote end of the racket. For a 19-string racket, it should be between the 12th and 13th strings, and for a 20-string racket, it should be between the 13th and 14th strings. In all cases, of course, the device 10 should be positioned symmetrically with respect to the racket handle.

It has been found that, in most cases, a single hour's practice with the device 10 installed on the player's racket 14, is equivalent to many hours of intense coaching without use of the device. The player quickly learns to associate the sound of the device with the physical sensations of the arm and body when the ball is correctly contacted by the sweet spot of the racket. Naturally, the device 10 is intended only for practice sessions, although its presence does not unduly affect the power of the racket, and it could, if desired, be used for regular play as well.

It will be appreciated that the present invention represents a substantial advance in the tennis teaching field. It provides a hitherto unavailable device for teaching players of all skill levels how to correctly hit the ball with the sweet spot of the racket, and thereby obtain better velocity and control of the ball. It will also be appreciated that, although a particular embodiment of the invention has been described in detail for purposes of illustration, various changes and modifications may be made without departing from the spirit and scope of the invention. Accordingly, the invention is not to be limited except as by the appended claims.

I claim:

1. A device for providing an audible indication when a tennis ball is struck with a desired area of a tennis racket, said device comprising:

two thin flat plates, each having a smaller planar area than that of the head of a conventional tennis recquet and being of stiff but resilient material disposable one on each side of the strings of the head of a tennis racket at the desired area;

at least one area of padding material having a smaller planar area than each of said plates and affixed to the side of each of said plates between each of said plates and the strings; of the head of the tennis recquet and a plurality of compressing fasteners attached to said plates and disposable through graps between the strings, for attaching said plates together onto the strings;

whereby said padding material causes said device when disposed on a racket and struck by a tennis ball to emit a first distinctive sound when struck at its center and a second distinctive sound when struck at an off-center location, but has little or no significant effect on the ball rebound characteristics of the racket.

2. A device as set forth in claim 1, wherein said flat plates are of a high-pressure laminated plastic material.

3. A device as set forth in claim 1, wherein said compressing fasteners comprise pairs of threaded nuts and bolts, said bolts being disposed through aligned holes in said plates.

4. A device as set forth in claim 1, wherein said areas of padded material are two in number on each of said plates and are substantially diametrically opposed on said plates.

5. A device as set forth in claim 1, wherein each of said plates includes a target area at the center thereof, said target area having a color contrasting to the color of the remainder of said plate.

6. A device for providing an audible indication when a tennis ball is struck at the "sweet spot" area of a conventional lawn tennis racket, said device comprising:

two thin flat circular plates each having a smaller planar area than the head of a conventional tennis racquet and being of high-pressure laminated plastic material, a plate being disposable on each side of the strings of a tennis racket at the desired "sweet spot" area, each of said plates having a plurality of holes therethrough;

a pair of relatively soft pads affixed to the side of each of said plates between each of said plates and the strings of the head of a tennis racquet, each of said pads having a smaller planar area than each of said plates; and said plates being attachable to the strings of a tennis racquet by a threaded bolt extending through each of said holes in said plates and the gaps between said strings, said bolts being tightened by threaded nuts placed thereon;

whereby said pads cause said device when struck by a ball to give a first distinctive sound when struck at its center and a second distinctive sound when struck at an off-center location, but has little or no significant effect on the ball rebounding characteristics of the racket.

7. A device as set forth in claim 6, wherein each of said flat plates comprises a double thickness of high-pressure laminated plastic material, the two thicknesses being held together by an adhesive material.

* * * * *